US011164450B2

(12) United States Patent
Tsfasman et al.

(10) Patent No.: US 11,164,450 B2
(45) Date of Patent: Nov. 2, 2021

(54) TRAFFIC FLOW AT INTERSECTIONS

(71) Applicant: International Business Machines Corporation, Armonk, NY (US)

(72) Inventors: Arkadiy O. Tsfasman, Wappingers Falls, NY (US); John S. Werner, Fishkill, NY (US); Pasquale A. Catalano, Wallkill, NY (US); Andrew G. Crimmins, Montrose, NY (US)

(73) Assignee: International Business Machines Corporation, Armonk, NY (US)

( * ) Notice: Subject to any disclaimer, the term of this patent is extended or adjusted under 35 U.S.C. 154(b) by 209 days.

(21) Appl. No.: 16/460,830

(22) Filed: Jul. 2, 2019

(65) Prior Publication Data

US 2021/0005082 A1 Jan. 7, 2021

(51) Int. Cl.
*G08G 1/01* (2006.01)
*G08G 1/065* (2006.01)

(52) U.S. Cl.
CPC ..... *G08G 1/0145* (2013.01); *G08G 1/0112* (2013.01); *G08G 1/0116* (2013.01); *G08G 1/065* (2013.01)

(58) Field of Classification Search
CPC .... G08G 1/0145; G08G 1/065; G08G 1/0116; G08G 1/0112
See application file for complete search history.

(56) References Cited

U.S. PATENT DOCUMENTS 9,261,379 B1 2/2016 Chatham et al.
9,672,734 B1 * 6/2017 Ratnasingam ..... G08G 1/0968
9,784,592 B2 10/2017 Gupta et al.
9,959,624 B2 5/2018 Raghu et al.
10,424,196 B1 * 9/2019 McEnroe ..... H04L 67/22
2007/0159354 A1 7/2007 Rosenberg
2014/0129128 A1 5/2014 Haran
2016/0260328 A1 * 9/2016 Mishra ..... G08G 1/166
2017/0301237 A1 10/2017 MacNeille et al.
2017/0345228 A1 * 11/2017 Dibb ..... G08G 1/017
2020/0365029 A1 * 11/2020 Kourous-Harrigan ..... G05D 1/0257

FOREIGN PATENT DOCUMENTS

WO 2013006994 A1 1/2013

OTHER PUBLICATIONS

Wavetronix, "Smarter Traffic", https://www.wavetronix.com/en, known about as early as and downloaded on Jun. 17, 2019, pp. 1-7.

* cited by examiner

*Primary Examiner* — Aniss Chad
*Assistant Examiner* — Elijah W. Vaughan
(74) *Attorney, Agent, or Firm* — Kunzler Bean & Adamson

(57) ABSTRACT

A method for improving traffic flow at an intersection includes determining spacing data for a plurality of vehicles within traffic lanes that enable the plurality of vehicles to proceed to an intersection from a common direction, determining whether traffic flow proximate to the intersection is hindered due to spacings between the plurality of vehicles, and sending a request to at least one vehicle of the plurality of vehicles to move forward to improve the traffic flow proximate to the intersection. The spacing data may be derived from spacing-related sensor data captured by one or more vehicles of the plurality of vehicles. A corresponding apparatus and computer program product for executing the above method are also disclosed herein.

20 Claims, 8 Drawing Sheets

TRAFFIC FLOW AT INTERSECTIONS

BACKGROUND

The subject matter disclosed herein relates generally to vehicular traffic flow and specifically to detecting and mitigating blocked traffic flow at intersections.

Traffic gridlock can occur when traffic flow is blocked at intersections. Traffic gridlock reduces productivity, increases driver frustration and increases accident rates. Accidents can further block traffic and increase gridlock resulting in a downward spiral for traffic flow.

SUMMARY OF THE INVENTION

A method for improving traffic flow at an intersection includes determining spacing data for a plurality of vehicles within traffic lanes that enable the plurality of vehicles to proceed to an intersection from a common direction, determining whether traffic flow proximate to the intersection is hindered due to spacings between the plurality of vehicles, and sending a request to at least one vehicle of the plurality of vehicles to move forward to improve the traffic flow proximate to the intersection. The spacing data may be derived from spacing-related sensor data captured by one or more vehicles of the plurality of vehicles.

A corresponding apparatus and computer program product for executing the above method are also disclosed herein. In one embodiment, the apparatus includes a spacing determination module configured to determine spacing data for a plurality of vehicles within traffic lanes that enable the plurality of vehicles to proceed to an intersection from a common direction, a flow assessment module configured to determine whether traffic flow proximate to the intersection is hindered due to spacings between the plurality of vehicles, and a communication module configured to send a request to at least one vehicle of the plurality of vehicles to move forward to improve the traffic flow proximate to the intersection.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

One of skill in the art will appreciate that references throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Figure 1A:
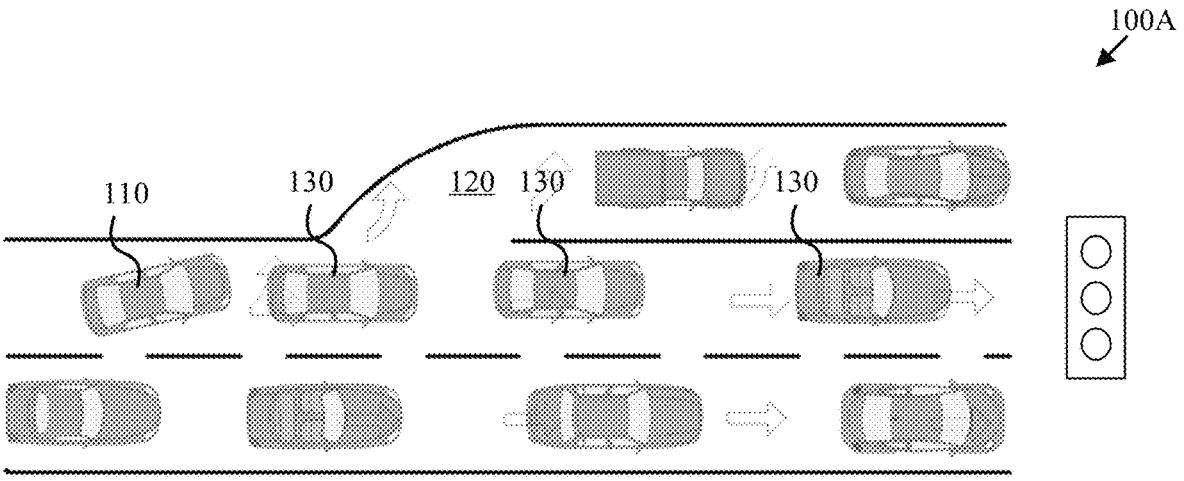
FIGS. 1A and 1B are plan view diagrams of two examples of scenarios where traffic flow is unnecessarily blocked in accordance with at least one embodiment disclosed herein.
Figure 1B:
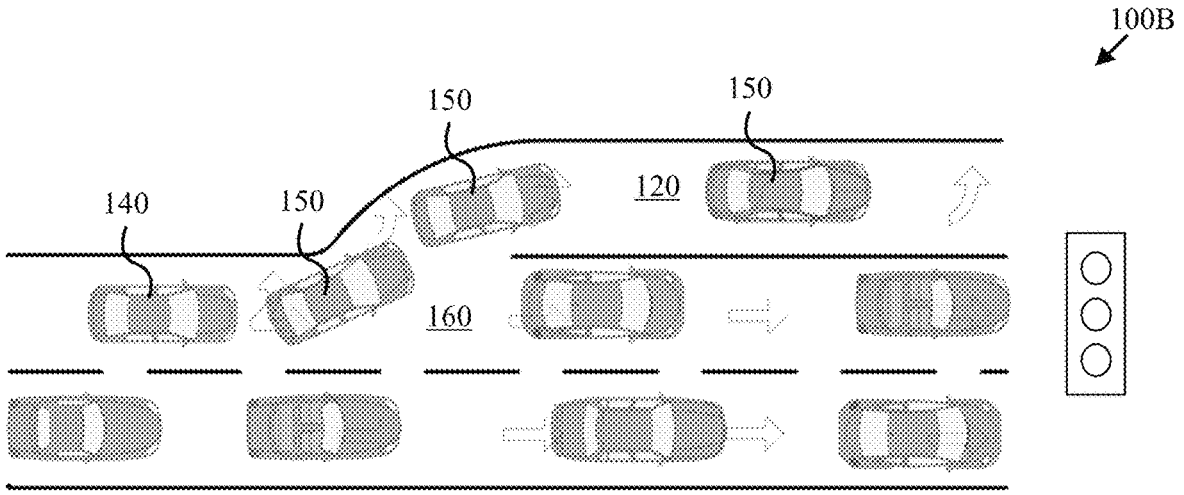

FIGS. 1A and 1B are plan view diagrams 100 of two examples of scenarios where traffic flow is unnecessarily blocked in accordance with at least one embodiment disclosed herein. The depicted scenarios include a first scenario 100A and a second scenario 100B. The depicted scenarios provide two examples of how traffic flow can be unnecessarily blocked at intersections.

In the first scenario 100A, a turning vehicle 110 is trying to get into a turn lane 120 and is blocked by blocking vehicles 130 in front of the turning vehicle 110 due to the excess spacing between, and in front of, the blocking vehicles 130. In the second scenario 100B, a proceeding vehicle 140 is trying to go straight through an intersection and is blocked by turning vehicles 150 that have not eliminated the excess space between, and in front of, those vehicles. Consequently, some of the turning vehicles 150 extend into a non-turning lane 160 and block traffic headed toward the intersection including the proceeding vehicle 140.

Figure 2:
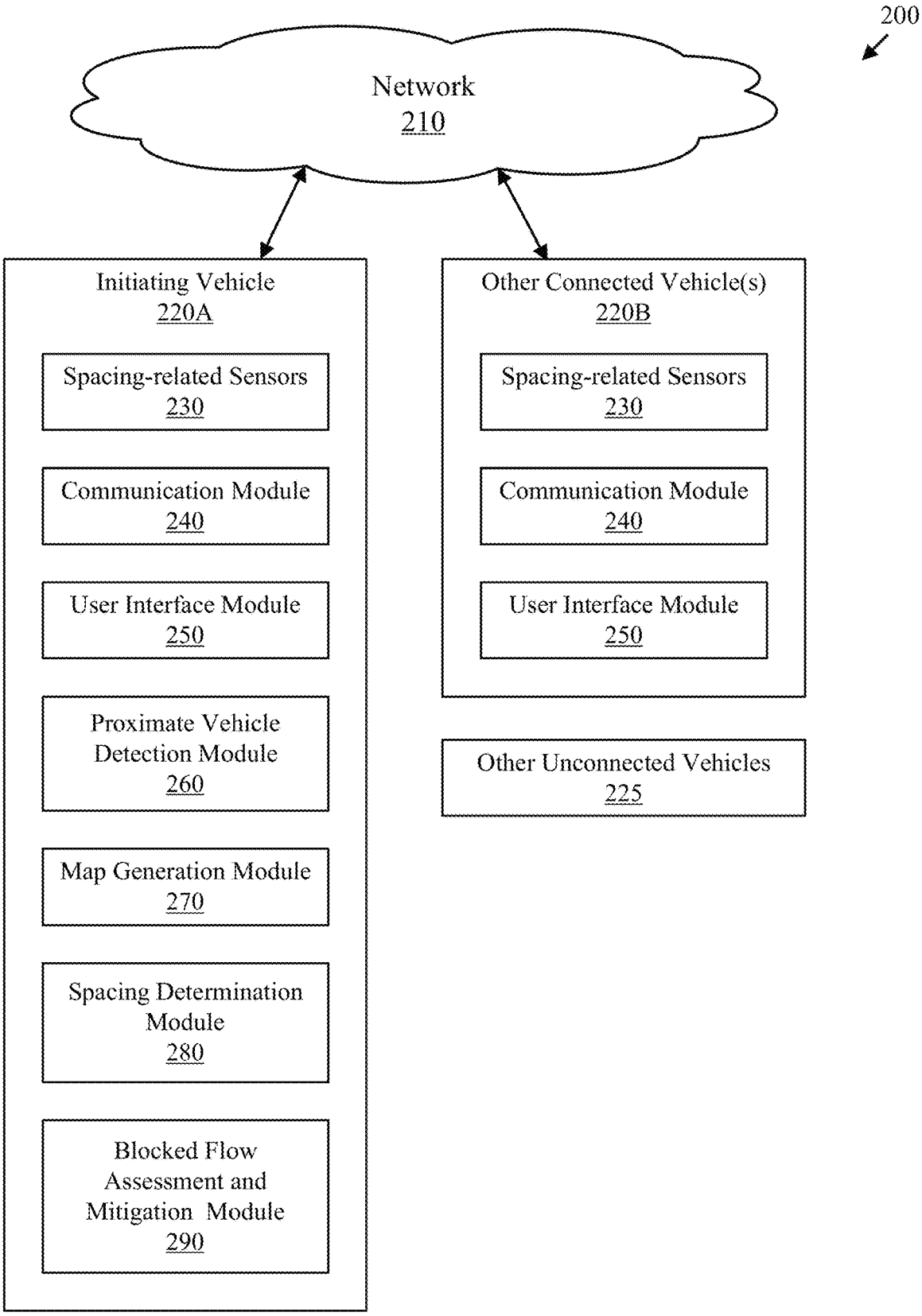
FIG. 2 is a block diagram of one example of a traffic management system in accordance with at least one embodiment disclosed herein.

FIG. 2 is a block diagram of one example of a traffic management system 200 in accordance with at least one embodiment disclosed herein. As depicted, the traffic management system 200 includes a number of connected vehicles 220 that function cooperatively to improve traffic flow. For purposes of discussion, the depicted connected vehicles 220 are partitioned into an initiating vehicle 220A and other connected vehicles 220B. Other unconnected vehicles 225 may also be present in the environment where the connected vehicles 220 are operating. In some embodiments, each connected vehicle 220 can assume the role of the initiating vehicle 220A in order to mitigate blocked traffic flow experienced by that particular vehicle.

The network 210 enables communication between the vehicles 220. Examples include vehicle-to-vehicle (V2V) networks and vehicle-to-infrastructure (V2I) networks. Communication with road infrastructure elements (not shown) such as traffic lights may also be enabled. Each of the depicted connected vehicles 220 may be equipped with spacing-related sensors 230, a communication module 240, and a user interface module 250. The spacing-related sensors 230 enable the collection of spacing-related sensor data (not shown).

The communication module 240 enables communication between the vehicles 220 via the network 210. The user interface module 250 enables communication with occupants of the vehicles 220 including the vehicle driver. The communication may be audible (e.g., via speakers) and/or visual (e.g., via consoles, heads-up displays, and smart windshields). The spacing-related sensor data provided by the vehicles 220 facilitate determination of the current spacings between vehicles. The sensors 230 that provide such data may be integrated into one or more data collection subsystems (not shown) that enable the autonomous capture and aggregation of the spacing-related sensor data. Examples of such sensors and subsystems include radar units, lidar units, sonar units, high accuracy GPS units, and cameras (e.g., infrared and visible light). In some embodiments, the sensors 230 and corresponding subsystems that provide the spacing-related sensor are already used for other features of the vehicle such as automatic braking, lane keep assist, better visibility and the like.

The depicted initiating vehicle 220A also includes a proximate vehicle detection module 260, a map generation module 270, a spacing determination module 280, and a blocked flow assessment and mitigation module 290. The various depicted modules enable the initiating vehicle 220A to detect blocked traffic and direct one or more mitigation processes to unblock traffic and improve traffic flow.

The proximate vehicle detection module 260 detects vehicles that are proximate to the current vehicle and/or an intersection. In some embodiments, a discovery request is broadcast by the initiating vehicle 220A over the network 210. In certain embodiments, the discovery request may indicate the current approximate (e.g., GPS) position of the initiating vehicle 220A. A radius of interest may also be indicated or defaulted to the direct wireless broadcasting range of the initiating vehicle over the network 210. Vehicles that receive the discovery request may determine if they are within the radius of interest (if specified) and subsequently respond to the discovery request with timestamped relevant information such as their current approximate (GPS) position, direction of travel (i.e., bearing), travel speed and turn indicator status. The provided information may be used to determine which vehicles should be queried for additional spacing-related data. The spacing-related data may be sensor data or data derived therefrom. Vehicle-specific data such as vehicle length and width may also be provided in response to the discovery request or the query for spacing-related data. The provided discovery information, vehicle-specific data and spacing-related data may be used to detect the presence and position of other vehicles 225 that are not connected to the network 210 but are proximate to responding vehicles.

In some embodiments, the map generation module 270 uses the discovery information, vehicle-specific data and the spacing-related data to build a vehicle placement map (not shown in FIG. 2). The vehicle placement map may show vehicles that are proximate to an intersection and the initiating vehicle 220A. The vehicle placement map may correspond to traffic approaching an intersection from a common direction (i.e., traffic that is facing an intersection). In some embodiments, the vehicle placement map is generated by overlaying a plurality of partial maps that each correspond to a vehicle that provides spacing-related data. The partial maps may be generated by the initiating vehicle 220A. Alternately, at least some of the partial maps may be generated on the corresponding vehicles 220B themselves.

The spacing determination module 280 determines spacing data for the traffic approaching an intersection from a common direction. The spacing data may be extracted from the vehicle placement map or derived directly from the spacing-related data provided by the queried vehicles.

The blocked flow assessment and mitigation module 290 assesses whether traffic flow is blocked and whether the flow can possibly be unblocked via one or more blocked traffic mitigation processes. The flow assessment module 290 may then initiate at least one of the blocked traffic mitigation processes.

Figure 3A:
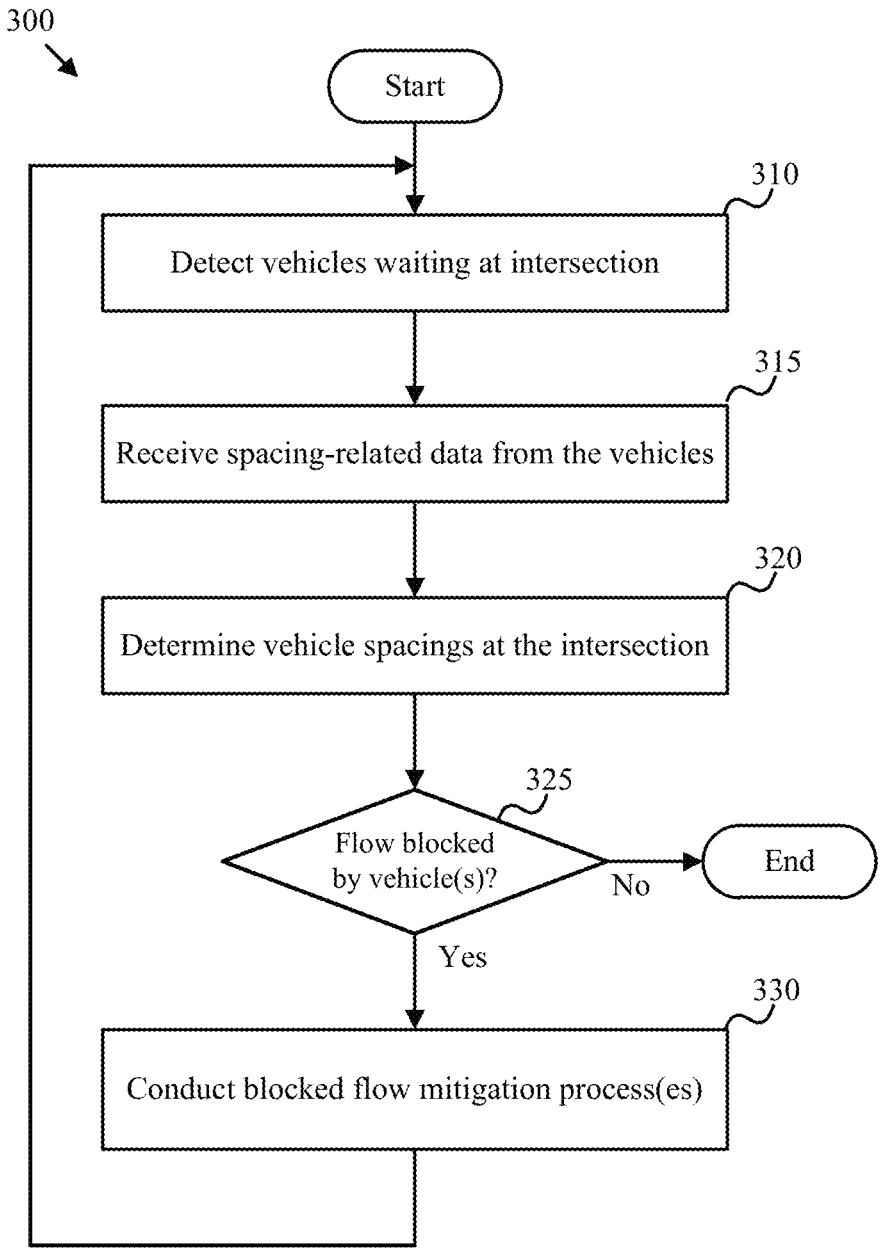
FIG. 3A is a flowchart of one example of a traffic management method in accordance with at least one embodiment disclosed herein.

FIG. 3A is a flowchart of one example of a traffic management method 300 in accordance with at least one embodiment disclosed herein. As depicted, the traffic management method 300 includes detecting (310) vehicles waiting at an intersection, receiving (315) spacing-related data, determining (320) vehicle spacings at the intersection, determining (325) whether traffic flow is blocked, and conducting (330) one or more blocked traffic mitigation processes. The traffic management method 300 may be conducted in accordance with the traffic management system 200 or the like. In some embodiments, vehicle operators or passengers can optionally indicate via the user interface module 250 that their intended path of travel is blocked. In response to the indication, that particular vehicle may assume the role of the initiating vehicle 220A and commence execution of the traffic management method 300.

Detecting (310) vehicles waiting at an intersection may include activating the proximate vehicle detection module 260. In some embodiments, a discovery request is broadcast over the network 210. Connected vehicles that are within a selected distance may respond to the discovery request with position and velocity information as well as a timestamp. The provided data may be analyzed against a road map to determine which vehicles are waiting proximate to a specific intersection. The direction of intended travel for (heading of) each vehicle may also be determined.

Receiving (315) spacing-related data may include receiving such data in response to a request for spacing-related data. In some embodiments, the request for such data is sent to connected vehicles that are determined to be waiting at the specific intersection. The spacing-related data may correspond to spacings between both connected and unconnected vehicles.

Determining (320) vehicle spacings at the intersection may include processing the spacing-related data to determine vehicles spacings between both connected and unconnected vehicles that are approaching, or at, the intersection. For example, one or more unconnected vehicles may be positioned in front of, beside, or behind one or more connected vehicles. Data from the connected vehicles may enable determination of the vehicle spacings of the unconnected vehicles and also determination of the minimum space available for making positioning adjustments that could potentially mitigate blocked traffic flow.

Determining (325) whether traffic flow is (unnecessarily) blocked may include determining whether a vehicle is blocked from its intended direction of travel and whether adjustments in vehicle spacings could be made to mitigate the blocked traffic flow. In some embodiments, each connected vehicle is responsible for determining whether their intended direction of travel is unnecessarily blocked.

In addition to vehicle spacings, other information can be used to determine whether traffic flow is blocked such as user input, turn signal data, programmed GPS routes, typical routes driven at the current time (e.g., driver commutes to or from work at a similar time daily), recognition of a vehicle between two lanes (i.e., starting to get into a turning lane, but can't fit), recognition of vehicles attempting to go around other vehicles and the like.

Conducting (330) one or more blocked traffic mitigation processes may include sending one or more requests to the (other) connected vehicles 220B to move forward and unblock traffic flow (while maintaining an appropriate buffer distance for safety such as 5 feet). In some embodiments, such requests are presented to the vehicle operators of the connected vehicles 220B.

Figure 3B:
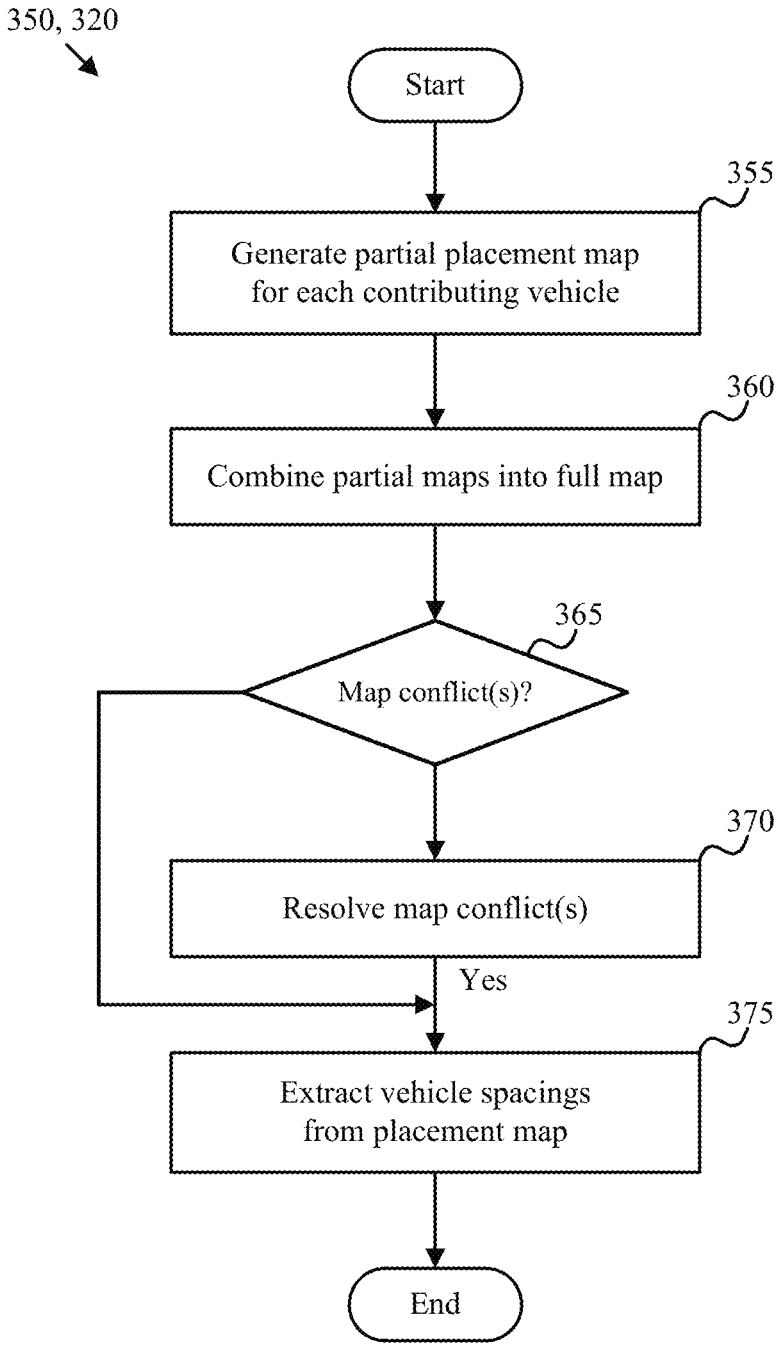
FIG. 3B is a flowchart of one example of a vehicle spacing determination method in accordance with at least one embodiment disclosed herein.

FIG. 3B is a flowchart of one example of a vehicle spacing determination method 350 in accordance with at least one embodiment disclosed herein. As depicted, the vehicle spacing determination method 350 includes generating (355) a partial placement map for each contributing vehicle, combining (360) the partial maps, determining (365) whether there are map conflicts, resolving (370) map conflicts, and extracting (375) vehicle spacings from the placement map. The vehicle spacing determination method 350 may be conducted as step 320 of the traffic management method 300.

Generating (355) a partial placement map for each contributing vehicle may include generating, for each contributing, a vehicle-specific (e.g., vehicle-relative) placement map using the data provided by that vehicle. The generated partial placement map may be generated by the initiating vehicle or by the contributing vehicle itself.

One of skill in the art will appreciate that data from vehicles traveling in different directions (e.g., cars passing perpendicular through the intersection, cars on the other side of the intersection, etc.) may be discarded. Furthermore, camera data (e.g., visible or infrared) may be analyzed using visual recognition (e.g., Watson™ Visual Recognition API) and can be trained to recognize objects such as vehicles, vehicle attachments or loads such as trailers, bike racks, lumbar, and carpet rolls, traffic lights, pedestrians, trees, storefronts, etc. and calculate approximate distances between objects. Additionally, such camera data may also be used to identify vehicles (vehicle make, model, and year) from many different angles such that a database could be accessed to retrieve vehicle information such as the size of the vehicle.

Combining (360) the partial maps may include overlaying the partial placement maps over each other to provide a complete placement map including the placement of unconnected vehicles. Determining (365) whether there are map conflicts may include detecting if any vehicle is placed in more than one position on the complete placement map. Such conflicts may occur because a vehicle is slowing moving forward resulting in mapping of the vehicle at multiple times by multiple vehicles.

Resolving (370) map conflicts may include comparing timestamps for conflicting data and prioritizing the most recent data. Other prioritization factors such as number of sources and source propinquity (distance from the data source) may also be used to resolve conflicts. Extracting (375) vehicle spacings from the placement map may include computing a distance between each pair of adjacent vehicles in the placement map.

It should be noted that while no data will be received directly from the unconnected vehicles to facilitate the operations of vehicle spacing determination method 350 (and other methods and operations disclosed herein), data from surrounding connected vehicles can be pieced together to conduct the described operations. For example, vehicle identification information such as make, model, type (e.g., sedan, truck and minivan), color, license plate information, registration stickers, bumper stickers, etc. provided by connected vehicles can be used to help identify both connected and unconnected vehicles within the vehicle spacing determination method 350 and the like.

Figure 3C:
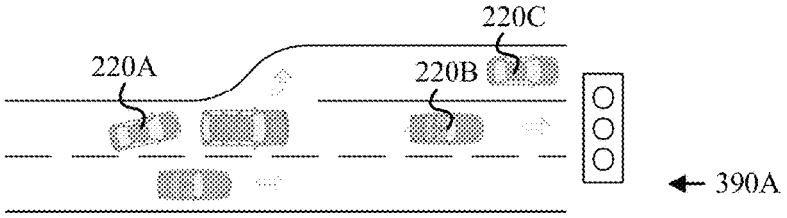
FIGS. 3C-3F are plan view diagrams of one example of how a combined vehicle placement map can be constructed from partial maps in accordance with at least one embodiment disclosed herein.
Figure 3D:
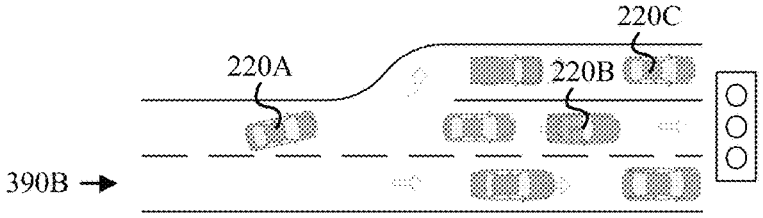
Figure 3E:
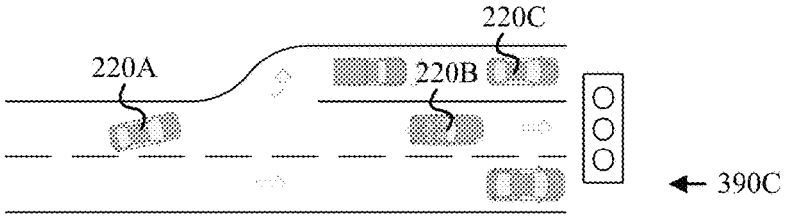
Figure 3F:
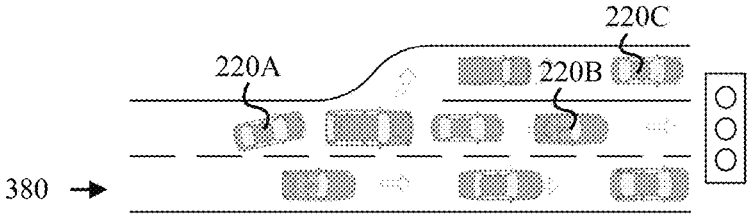

FIGS. 3C-3F are plan view diagrams of one example of how a combined vehicle placement map 380 can be constructed from partial maps 390 in accordance with at least one embodiment disclosed herein. FIG. 3C depicts a first partial map corresponding to spacing-related data provided by a first connected vehicle 220A. FIG. 3D depicts a second partial map corresponding to spacing-related data provided by a second connected vehicle 220B. FIG. 3E depicts a third partial map corresponding to spacing-related data provided by a third connected vehicle 220C. Lastly, FIG. 3F depicts a complete vehicle placement map 380 compiled from the partial maps 390.

One of skill in the art will appreciate that while the connected vehicles 220 may be aware of each other, their ability to detect the other vehicles shown on the various maps (which are assumed to be unconnected vehicles) may be limited by line of sight from the various sensors (not shown) used by the connected vehicles 220. Consequently, each of the partial maps 390 are typically only able to include unconnected vehicles that are adjacent to the connected vehicle 220 which provides the data used to generate that partial map. However, by combining partial maps 390 the combined vehicle placement map 380 may be generated. In some embodiments, in addition to generating partial maps from vehicle provided data partial may be generated from data provided by infrastructure elements such as traffic monitoring systems and cameras/sensors for traffic lights.

Figure 4:
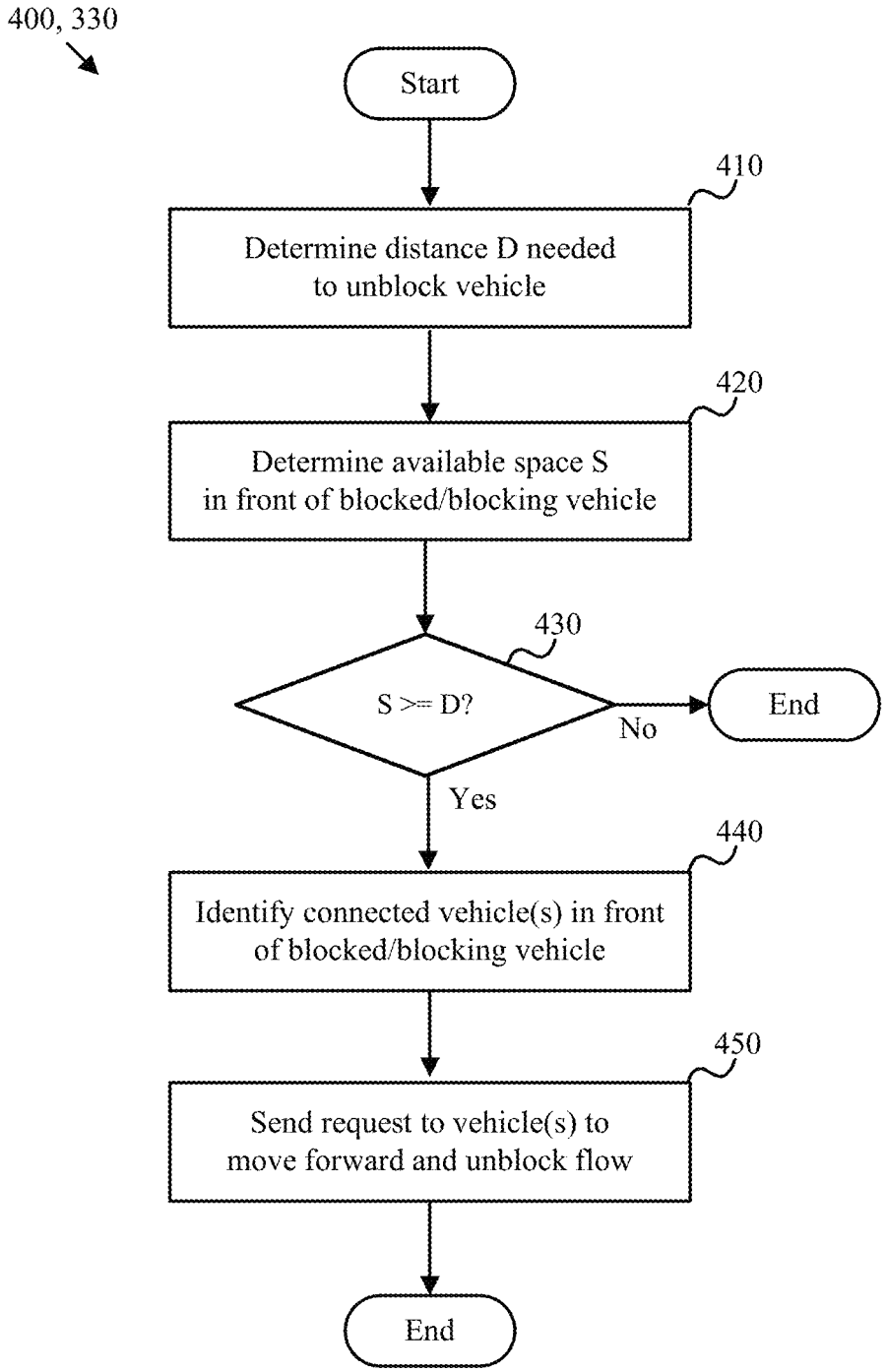
FIG. 4 is a flowchart of one example of vehicle unblocking method in accordance with at least one embodiment disclosed herein.

FIG. 4 is a flowchart of one example of a vehicle unblocking method 400 in accordance with at least one embodiment disclosed herein. As depicted, the vehicle unblocking method 400 includes determining (410) a distance D needed to unblock a vehicle, determining (420) an available space S in front of blocked/blocking vehicle, determining (430) whether the available space S is sufficient, identifying (440) one or more connected vehicles in front of the blocked or blocking vehicle, and sending (450) a request to move forward. The vehicle unblocking method 400 is one example of a blocked traffic mitigation process that may be conducted in conjunction with module 290 of the traffic management system 200 and step 330 of the traffic management method 300.

Determining (410) the distance D needed to unblock a vehicle may include determining the distance needed by a blocked vehicle to reach a turning lane entry point (the scenario depicted in FIG. 1A) or the distance needed by a blocking vehicle to enter into a turning lane (the scenario depicted in FIG. 1B). The determined distance D may account for buffer space needed to maintain a safety margin between vehicles and prevent accidents. In some embodiments, the distance D is extracted from a placement map.

Determining (420) the available space S may include summing the space between and in front of one or more vehicles that are in front of the blocked or blocking vehicle while accounting for a required buffer/safety space between each pair of adjacent vehicles in front of the blocked or blocking vehicle (e.g., 5 feet). For example, the cumulative buffer/safety space may be subtracted from the computed sum of all space in front of the blocked or blocking vehicle to yield the available space S.

Determining (430) whether the available space S is sufficient may include determining whether the available space S is greater than or equal to D. If the available space S is not sufficient, the method terminates. If the available space S is sufficient, the method proceeds by identifying (440) one or more vehicles in front of the blocked vehicle.

Identifying (440) one or more vehicles in front of the blocked or blocking vehicle may include referencing a vehicle placement map to determine which connected vehicles are in front of the blocked or blocking vehicle.

Sending (450) a request to move forward may include sending a request to each of the connected vehicles that are in front of the blocked or blocking vehicle to move forward to unblock traffic flow. Instructions may also be sent for autonomous or semi-autonomous vehicles to move them forward automatically (e.g., after visually and/or aurally informing the vehicle drivers or occupant/occupants). The connected vehicles may move forward in response to the request. Furthermore, any unconnected vehicles that are in front of the blocked or blocking vehicle may also move forward in response to seeing the connected vehicles move forward.

One of skill in the art will appreciate that the methods presented herein may be conducted iteratively to unblock traffic flow. For example, attempts to unblock traffic via the vehicle unblocking method 400 or some other mitigation process may not be entirely successful or new blockage may occur in response to such attempts. Consequently, the method that invoked the method 400 (e.g., the traffic management method 300) may restart after waiting a selected interval (e.g., 5 seconds). Under such a scenario, spacing-related data may be re-collected from any relevant connected vehicles and used to detect whether any blockage persists and whether the detected blockage can be mitigated.

Figure 5A:
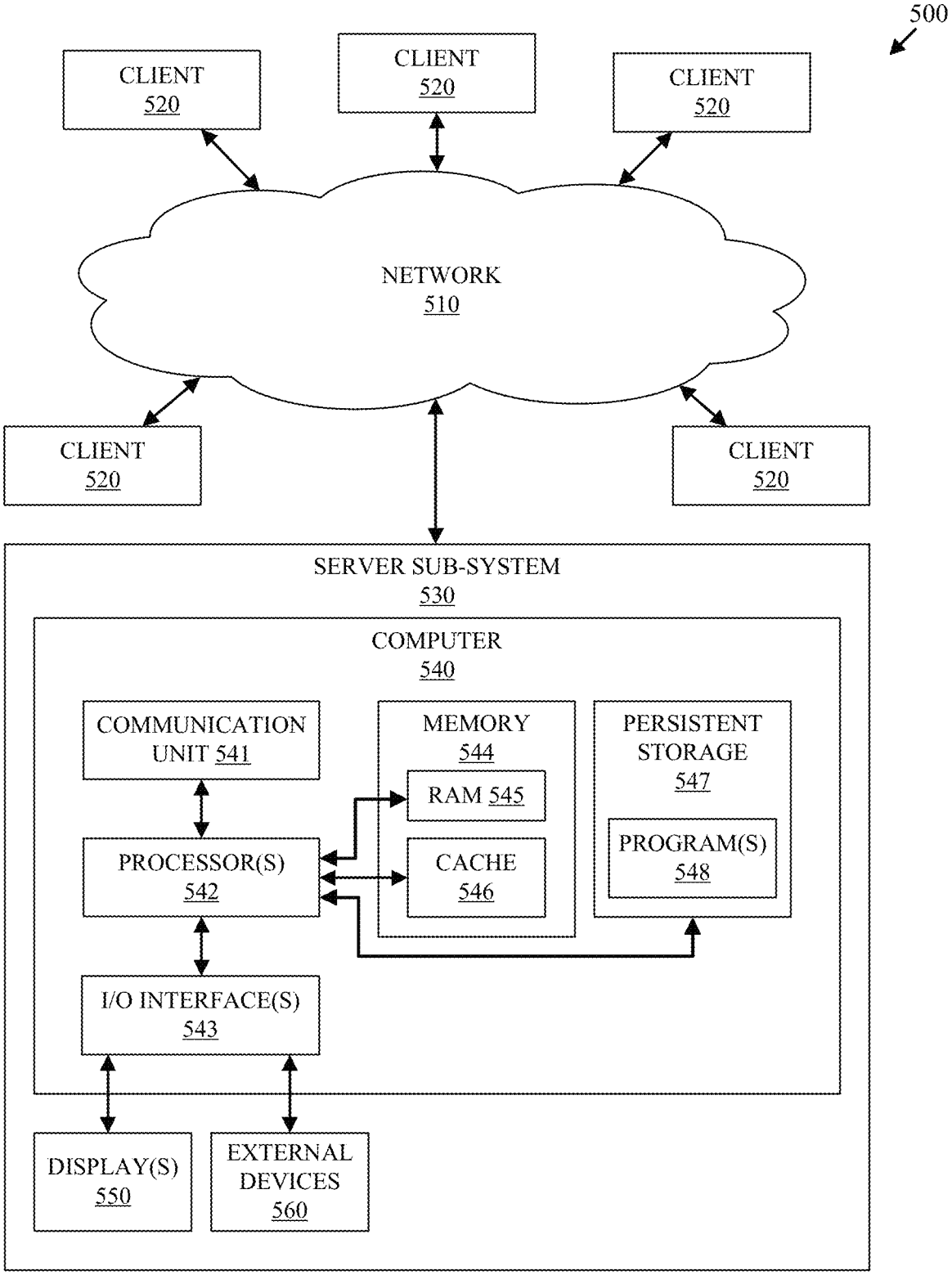
FIG. 5A is a block diagram illustrating various portions of a computing environment in accordance with at least one embodiment disclosed herein.

FIG. 5A is a block diagram illustrating various portions of a computing system 500 in accordance with at least one embodiment disclosed herein. As depicted, computing system 500 includes a communication network 510, one or more client devices 520, and at least one server subsystem 530. The depicted server subsystem 530 includes at least one computer 540 connected to one or more displays 550 and one or more external devices 550. The depicted computer 540 includes a communication unit 541, one or more processors 542, a set of I/O interfaces 543, memory 544, including random access (i.e., main) memory 545 and cache memory 546, and persistent storage 547 that stores one or more programs or executables 548.

Similar to the depicted subsystem 530, the clients 520 may comprise a computer 540. Subsystem 530 and computer 540 are, in many respects, representative of the subsystems and devices that can execute at least a portion of one or more methods disclosed herein. Accordingly, several portions of subsystem 530 and computer 540 will now be discussed in the following paragraphs.

Computer 540 may be a laptop computer, tablet computer, netbook computer, personal computer (PC), desktop computer, personal digital assistant (PDA), smart phone, or any programmable electronic device capable of communicating via network 510. Each executable 548 is a collection of machine readable instructions and/or data that is used to perform at least some of the software functions discussed herein. For example, the methods describe herein may correspond to one or more executables 548.

Computer 540 is capable of communicating with other computing devices, such as the clients 520 and other subsystems 530, via communication network 510. Communication network 510 can be, for example, a local area network (LAN), a wide area network (WAN) such as the Internet, or a combination of the two, and can include wired, wireless, or fiber optic connections. In general, communication network 510 can be any combination of connections and protocols that will support communications between computing devices such as the server subsystem and client subsystems.

Computer 540 is shown as a block diagram with many double arrows. These double arrows (no separate reference numerals) represent a communications fabric, which provides communications between various components of computer 540. This communications fabric can be implemented with any architecture designed for passing data and/or control information between processors (such as microprocessors, communications and network processors, etc.), system memory, peripheral devices, and any other hardware component within a system. For example, the communications fabric can be implemented, at least in part, with one or more buses.

Memory 544 and persistent storage 547 are computer-readable storage media. In general, memory 544 can include any suitable volatile or non-volatile computer-readable storage media. It is further noted that, now and/or in the near future: (i) external device(s) 560 may be able to supply some or all memory for subsystem 530; and/or (ii) devices external to subsystem 530 may be able to provide memory for subsystem 530.

The programs 548 are stored in persistent storage 547 for access and/or execution by one or more of the respective computer processors 542, usually through one or more memories of memory 544. Persistent storage 547: (i) is at least more persistent than a signal in transit; (ii) stores the programs (including its soft logic and/or data) on a tangible medium (such as magnetic or optical domains); and (iii) may be substantially less persistent than permanent storage. Alternatively, data storage may be more persistent and/or permanent than the type of storage provided by persistent storage 547.

Programs 548 may include both machine readable and performable instructions, and/or substantive data (e.g., the type of data stored in a database). In one particular embodiment, persistent storage 547 includes a magnetic hard disk drive. To name some possible variations, persistent storage 547 may include a solid state hard drive, a semiconductor storage device, read-only memory (ROM), erasable programmable read-only memory (EPROM), flash memory, or any other computer-readable storage media that is capable of storing program instructions or digital information.

The media used by persistent storage 547 may also be removable. For example, a removable hard drive may be used for persistent storage 547. Other examples include optical and magnetic disks, thumb drives, and smart cards that are inserted into a drive for transfer onto another computer-readable storage medium that is also part of persistent storage 547.

Communications unit 541 in the depicted example provides for communications with other data processing systems or devices external to subsystem 520. In these examples, communications unit 541 includes one or more network interface cards. Communications unit 541 may provide communications through the use of either, or both, physical and wireless communications links. Any software modules discussed herein may be downloaded to a persistent storage device (such as persistent storage device 560) through a communications unit (such as communications unit 541).

I/O interface set 543 allows for input and output of data with other devices that may be connected locally in data communication with computer 540. For example, I/O interface set 543 provides a connection to external device set 560. External device set 560 will typically include devices such as a keyboard, keypad, touch screen, and/or some other suitable input device. External device set 560 can also include portable computer-readable storage media such as, for example, thumb drives, portable optical or magnetic disks, and memory cards. Software and data used to practice embodiments of the present invention, for example, programs 548, can be stored on such portable computer-readable storage media. In these embodiments the relevant software may (or may not) be loaded, in whole or in part, onto persistent storage device 560 via I/O interface set 543. I/O interface set 543 also connects in data communication with display device 550. Display device 550 provides a mechanism to display data to a user and may be, for example, a computer monitor or a smart phone display screen.

Figure 5B:
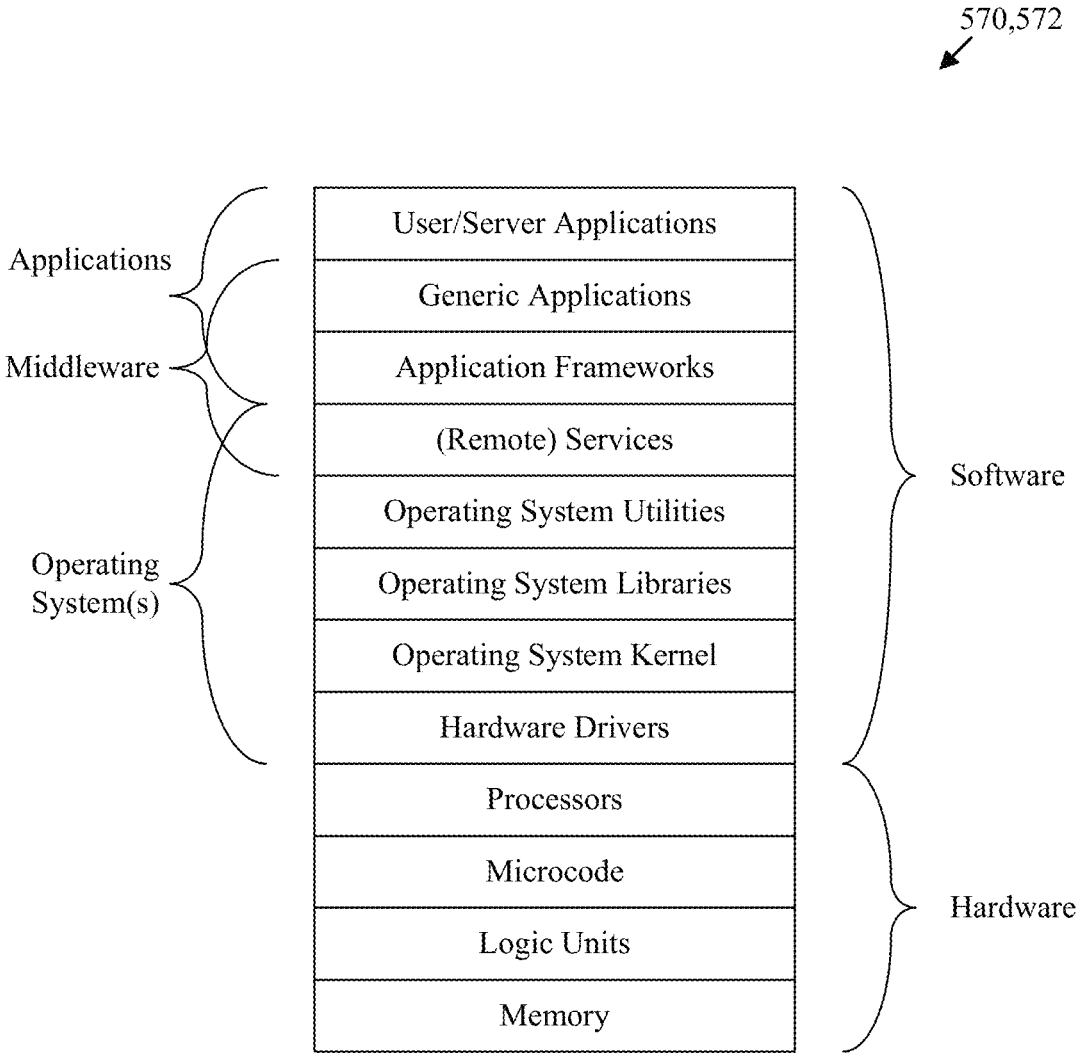
FIG. 5B is a block diagram illustrating one example of a computing stack in accordance with at least one embodiment disclosed herein.

FIG. 5B is a block diagram illustrating one example of a computing stack 570 in accordance with at least one embodiment disclosed herein. As depicted, the computing stack 570 includes a number of computing layers 572 used for conducting computing operations. In the depicted embodiment, the layers include hardware layers and software layers. The various software layers include operating system layers associated with executing one or more operating systems, middleware layers associated with executing middleware that expands and/or improves the functionality of hardware layers, and executing operating system(s). The software layers may also include various application-specific layers. The application-specific layers may include application frameworks that further expand on, and/or improve upon, the functionality of hardware layers and operating system layers.

The memory layer may include volatile memory, non-volatile memory, persistent storage and hardware associated with controlling such memory. The logic units may include CPUs, arithmetic units, graphic processing units, and hardware associated with controlling such units. The microcode layer may include executable instructions for controlling the processing flow associated with moving data between memory and the logic units. The processor layer may include instruction fetch units, instruction decode units, and the like that enable execution of processing instructions and utilization of the underlying hardware layers.

The hardware drivers (also known as the hardware abstraction layer) may include executable code that enables an operating system to access and control storage devices, DMA hardware, I/O buses, peripheral devices, and other hardware associated with a computing environment. The operating system kernel layer may receive I/O requests from higher layers and manage memory and other hardware resources via the hardware drivers. The operating system kernel layer may also provide other functions such as inter-process communication and file management.

Operating system libraries and utilities may expand the functionality provided by the operating system kernel and provide an interface for accessing those functions. Libraries are typically leveraged by higher layers of software by linking library object code into higher level software executables. In contrast, operating system utilities are typically standalone executables that can be invoked via an operating system shell that receives commands from a user and/or a script file. Examples of operating system libraries include file I/O libraries, math libraries, memory management libraries, process control libraries, data access libraries, and the like. Examples of operating system utilities include anti-virus managers, disk formatters, disk defragmenters, file compressors, data or file sorters, data archivers, memory testers, program installers, package managers, network utilities, system monitors, system profilers, and the like.

Services are often provided by a running executable or process that receives local or remote requests from other processes or devices called clients. A computer running a service is often referred to as a server. Examples of servers include database servers, file servers, mail servers, print servers, web servers, game servers, and application servers.

Application frameworks provide functionality that is commonly needed by applications and include system infrastructure frameworks, middleware integration, frameworks, enterprise application frameworks, graphical rendering frameworks, and gaming frameworks. An application framework may support application development for a specific environment or industry. In some cases, application frameworks are available for multiple operating systems and providing a common programming interface to developers across multiple platforms.

Generic applications include applications that are needed by most users. Examples of generic applications include mail applications, calendaring and scheduling applications, and web browsers. Such applications may be automatically included with an operating system.

One of skill in the art will appreciate that an improvement to any of the depicted layers, or similar layers that are not depicted herein, results in an improvement to the computer itself including the computer 540 and/or the client devices 510. One of skill in the art will also appreciate that the depicted layers are given by way of example are not representative of all computing devices. Nevertheless, the concept of improving the computer itself by improving one or more functional layers is essentially universal.

The executables and programs described herein are identified based upon the application or software layer for which they are implemented in a specific embodiment of the present invention. However, it should be appreciated that any particular program nomenclature herein is used merely for convenience, and thus the present invention should not be limited to use solely in any specific identified application or software layer.

The features, advantages, and characteristics of the embodiments described herein may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The present invention may be a system, a method, and/or a computer program product. The computer program product may include a computer-readable storage medium (or media) having computer-readable program instructions thereon for causing a processor to carry out aspects of the present invention.

The computer-readable storage medium can be a tangible device that can retain and store instructions for use by an instruction execution device. The computer-readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer-readable storage medium includes the following: a portable computer diskette, a hard disk, a random access memory ("RAM"), a read-only memory ("ROM"), an erasable programmable read-only memory ("EPROM" or Flash memory), a static random access memory ("SRAM"), a portable compact disc read-only memory ("CD-ROM"), a digital versatile disk ("DVD"), a memory stick, a floppy disk, a mechanically encoded device such as punch-cards or raised structures in a groove having instructions recorded thereon, and any suitable combination of the foregoing. A computer-readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer-readable program instructions described herein can be downloaded to respective computing/processing devices from a computer-readable storage medium or to an external computer or external storage device via a network, for example, the Internet, a local area network, a wide area network, and/or a wireless network. The network may comprise copper transmission cables, optical transmission fibers, wireless transmission, routers, firewalls, switches, gateway computers and/or edge servers. A network adapter card or network interface in each computing/processing device receives computer-readable program instructions from the network and forwards the computer-readable program instructions for storage in a computer-readable storage medium within the respective computing/processing device.

Computer-readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++, or the like, and conventional procedural programming languages, such as the "C" programming language or similar programming languages. The computer-readable program instructions may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA), may execute the computer-readable program instructions by utilizing state information of the computer-readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer-readable program instructions.

These computer-readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer-readable program instructions may also be stored in a computer-readable storage medium that can direct a computer, a programmable data processing apparatus, and/or other devices to function in a particular manner, such that the computer-readable storage medium having instructions stored therein comprises an article of manufacture including instructions which implement aspects of the function/act specified in the flowchart and/or block diagram block or blocks.

The computer-readable program instructions may also be loaded onto a computer, other programmable data processing apparatus, or other device to cause a series of operational steps to be performed on the computer, other programmable apparatus, or other device to produce a computer-implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Some of the functional units described in this specification may have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices, or the like.

Modules may also be implemented in software for execution by various types of processors. An identified module of program instructions may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

In the preceding description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

The description of elements in each figure may refer to elements of proceeding figures. Like numbers refer to like elements in all figures, including alternate embodiments of like elements. The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for improving traffic flow at an intersection, the method comprising:

automatedly determining, by a processor in real-time, spacing data for a plurality of vehicles within traffic lanes based on an electronic vehicle placement map comprised of a plurality of electronic partial maps, wherein the spacing data enables the plurality of vehicles to proceed to an intersection from a common direction;

automatedly determining, by the processor in real-time, whether traffic flow proximate to the intersection is hindered due to a spacing between at least two vehicles in the plurality of vehicles included in the spacing data, the at least two vehicles including at least a blocking vehicle and a blocked vehicle;

in response to determining that the traffic flow proximate to the intersection is hindered due to the spacing between the at least two vehicles, automatedly determining whether a cumulative amount of space in front of the blocking vehicle and between the blocking vehicle and the blocked vehicle is sufficient to clear the hinderance of the traffic flow proximate to the intersection due to the spacing between the at least two vehicles;

in response to determining that the cumulative amount of a first space in front of the blocking vehicle and a second space between the blocking vehicle and the blocked vehicle is sufficient to clear the hinderance of the traffic flow proximate to the intersection due to the spacing between the at least two vehicles automatedly sending an electronic request to one of the blocking vehicle to move forward to the first space in front of the blocking vehicle, the blocked vehicle to move forward to the second space between the blocking vehicle and the blocked vehicle, or both the blocking vehicle to move forward to the first space in front of the blocking vehicle and the blocked vehicle to move forward to the second space between the blocking vehicle and the blocked vehicle to improve the traffic flow proximate to the intersection, wherein the spacing in the spacing data is derived from spacing-related sensor data captured by one or more vehicles of the plurality of vehicles.

2. The method of claim 1, wherein:

the spacing data is extracted from the electronic vehicle placement map; and the electronic placement map is generated based on the spacing-related sensor data.

3. The method of claim 2, wherein the electronic vehicle placement map is generated by overlaying the plurality of electronic partial maps.

4. The method of claim 3, wherein each electronic partial map of the plurality of electronic partial maps corresponds to a vehicle equipped with one or more sensors configured to capture and provide the spacing-related sensor data to the processor.

5. The method of claim 1, wherein:

the processor is located on a first vehicle of the plurality of vehicles;

determining the spacing data comprises receiving, by the processor, the spacing-related data from a second vehicle of the plurality of vehicles; and the first vehicle is one of the blocking vehicle and the blocked vehicle.

6. The method of claim 5, wherein the spacing-related data corresponds to vehicle-captured sensor data.

7. The method of claim 5, wherein the spacing-related data comprises vehicle-captured sensor data.

8. The method of claim 5, wherein the spacing-related data comprises a partial map generated from vehicle-captured sensor data.

9. The method of claim 5, wherein the spacing-related data is received by the processor in response to the processor transmitting a request for the spacing-related data to the second vehicle.

10. The method of claim 1, wherein determining the spacing data comprises combining a plurality of vehicle-specific datasets.

11. The method of claim 10, wherein each vehicle-specific dataset corresponds to a vehicle equipped with spacing-related sensors.

12. The method of claim 10, wherein a vehicle-specific dataset of the plurality of vehicle-specific datasets is received from an originating vehicle.

13. The method of claim 10, wherein each vehicle-specific dataset comprises a partial map.

14. The method of claim 1, wherein traffic flow into a turn lane for the intersection is hindered due to vehicle spacings for the plurality of vehicles.

15. The method of claim 1, wherein non-turning traffic flow through the intersection is hindered due to vehicle spacings for the plurality of vehicles.

16. An apparatus for improving traffic flow at an intersection, the apparatus comprising:

a spacing determination module configured to automatedly determine, in real-time, spacing data for a plurality of vehicles within traffic lanes based on an electronic vehicle placement map comprised of a plurality of electronic partial maps, wherein the spacing data enables the plurality of vehicles to proceed to an intersection from a common direction;

a blocked flow assessment and mitigation module configured to automatedly determine, in real-time, whether traffic flow proximate to the intersection is hindered due to a spacing between at least two vehicles in the plurality of vehicles included in the spacing data, the at least two vehicles including at least a blocking vehicle and a blocked vehicle;

a spacing determination module configured to determine whether a cumulative amount of space in front of the blocking vehicle and between the blocking vehicle and the blocked vehicle is sufficient to clear the hinderance of the traffic flow proximate to the intersection due to the spacing between the at least two vehicles in response to determining that the traffic flow proximate to the intersection is hindered due to the spacing between the at least two vehicles;

a communication module configured to, in response to determining that the cumulative amount of a first space in front of the blocking vehicle and a second space between the blocking vehicle and the blocked vehicle is sufficient to clear the hinderance of the traffic flow proximate to the intersection due to the spacing between the at least two vehicles, automatedly send an electronic request to one of the blocking vehicle to move forward to the first space in front of the blocking vehicle, the blocked vehicle to move forward to the second space between the blocking vehicle and the blocked vehicle, or both the blocking vehicle to move forward to the first space in front of the blocking vehicle and the blocked vehicle to move forward to the second space between the blocking vehicle and the blocked vehicle to improve the traffic flow proximate to the intersection, wherein:

the spacing in the spacing data is derived from spacing-related sensor data captured by one or more vehicles of the plurality of vehicles, and at least a portion of each of said modules comprises one or more of a set of hardware circuits, a set of programmable hardware devices, and a set of non-transitory computer-readable storage media storing executable code comprising said portion of each of said modules.

17. The apparatus of claim 16, further comprising a map generation module configured to generate the electronic vehicle placement map for the plurality of vehicles based on the spacing-related sensor data.

18. The apparatus of claim 17, wherein the spacing data is extracted from the electronic vehicle placement map.

19. The apparatus of claim 16, wherein:

the apparatus is located on a first vehicle of the plurality of vehicles, and the communication module is further configured to receive the spacing-related data from one or more other vehicles of the plurality of vehicles.

20. A computer program product for improving traffic flow at an intersection, the computer program product comprising a computer-readable storage medium having program instructions embodied therewith, wherein the computer-readable storage medium is not a transitory signal per se, the program instructions executable by a processor that causes the processor to perform a method comprising:

automatedly determining, in real-time, spacing data for a plurality of vehicles within traffic lanes based on an electronic vehicle placement map comprised of a plurality of electronic partial maps, wherein the spacing data enables the plurality of vehicles to proceed to an intersection from a common direction;

automatedly determining, in real-time, whether traffic flow proximate to the intersection is hindered due to a spacing between at least two vehicles in the plurality of vehicles included in the spacing data, the at least two vehicles including at least a blocking vehicle and a blocked vehicle; and in response to determining that the traffic flow proximate to the intersection is hindered due to the spacing between the at least two vehicles, automatedly determining whether a cumulative amount of space in front of the blocking vehicle and between the blocking vehicle and the blocked vehicle is sufficient to clear the hinderance of the traffic flow proximate to the intersection due to the spacing between the at least two vehicles; and in response to determining that the cumulative amount of a first space in front of the blocking vehicle and a second space between the blocking vehicle and the blocked vehicle is sufficient to clear the hinderance of the traffic flow proximate to the intersection due to the spacing between the at least two vehicles automatedly sending an electronic request to one of the blocking vehicle to move forward to the first space in front of the blocking vehicle, the blocked vehicle to move forward to the second space between the blocking vehicle and the blocked vehicle, or both the blocking vehicle to move forward to the first space in front of the blocking vehicle and the blocked vehicle to move forward to the second space between the blocking vehicle and the blocked vehicle to improve the traffic flow proximate to the intersection, wherein the spacing in the spacing data is derived from spacing-related sensor data captured by one or more vehicles of the plurality of vehicles.

* * * * *